US009672999B1

(12) United States Patent
Zou

(10) Patent No.: US 9,672,999 B1
(45) Date of Patent: Jun. 6, 2017

(54) MECHANICAL KEYBOARD BUTTON STRUCTURE

(71) Applicant: Jiangsu Transimage Technology Co., Ltd, Yangzhou, Jiangsu Province (CN)

(72) Inventor: Weimin Zou, Yangzhou (CN)

(73) Assignee: Jiangsu Transimage Technology Co., Ltd., Yangzhou, Jiangsu Province (CN)

( * ) Notice: Subject to any disclaimer, the term of this patent is extended or adjusted under 35 U.S.C. 154(b) by 0 days.

(21) Appl. No.: 15/004,530

(22) Filed: Jan. 22, 2016

(30) Foreign Application Priority Data

Dec. 30, 2015 (CN) ..... 2015 1 1018649

(51) Int. Cl.
*H01H 13/14* (2006.01)
*H01H 13/20* (2006.01)

(52) U.S. Cl.
CPC ..... *H01H 13/14* (2013.01); *H01H 13/20* (2013.01); *H01H 2235/01* (2013.01)

(58) Field of Classification Search
CPC ..... H01H 13/14; H01H 13/705; H01H 13/10
USPC ..... 200/5 A, 530, 532
See application file for complete search history.

(56) References Cited

U.S. PATENT DOCUMENTS 4,447,681 A * 5/1984 Desmarais ..... H01H 13/705 200/5 A
2008/0121508 A1* 5/2008 Chuang ..... H01H 3/125 200/344
2015/0041298 A1* 2/2015 Izawa ..... H01H 13/023 200/5 A
2015/0101916 A1* 4/2015 Chen ..... H01H 3/125 200/5 A

* cited by examiner

*Primary Examiner* — Edwin A. Leon
*Assistant Examiner* — Iman Malakooti
(74) *Attorney, Agent, or Firm* — Rankin, Hill & Clark LLP

(57) ABSTRACT

The invention discloses a mechanical keyboard button structure including a base plate, a circuit board, a mechanical switch and a keycap, wherein the base plate, the circuit board, the mechanical switch and the keycap are connected in order from bottom to top; the mechanism switch is used for guiding the keycap to move up and down and converting a pressure of the keycap into a switch signal to transmit to the circuit board to communicate a circuit; the mechanical switch includes a supporting plate and a switch spindle arranged on the supporting plate and further includes a pair of scissors, the upper portion of the pair of scissors is fixed with the bottom surface of the keycap, while the lower portion is fixed with the supporting plate, and the switch spindle passes through the pair of scissors and supports against the bottom surface of the keycap. According to the invention, the mechanical axle structure is combined with the scissor structure, so that the button is supported more stably, the service life is long, and the corner has both better hand feeling and function; second, the structure can be used for the keyboard with a shorter stroke, so that the keyboard is thinner and lighter and is more widely applied in the market; at last the whole circuit does not need to be replaced when the trigger circuit below a single key is damaged, and the single button can be repaired and replaced.

2 Claims, 3 Drawing Sheets

MECHANICAL KEYBOARD BUTTON STRUCTURE

TECHNICAL FIELD

The invention relates to a keyboard structure, and more particular to a mechanical keyboard button structure.

BACKGROUND

A keyboard belongs to computer peripherals, the keyboard is provided with a plurality of keys, a signal or command is input and transmitted to a computer by pressing the plurality of keys, wherein it has a higher demand on the operating performance, the pressing life, the stroke and the operation hand feeling of the key.

A thin-film keyboard is a keyboard structure that is commonly used at present. The thin-film keyboard is mainly provided with a scissor pin support and an elastic element below the keycap and then is matched with a thin-film circuit layer arranged at the bottom. When pressing the keycap, the scissor pin support is used for fixing and stabilizing the keycap, the elastic element is driven by the keycap and triggers downward to enable an axial core pole to conduct to generate a signal, and the keycap is reset via an elastic force of the elastic element.

In addition, the mechanical keyboard has very large influence on the game player group, and both its reaction speed and hand feeling have the advantages that cannot be achieved by the common keyboard. As the game rises and the competitive game prevails, the demand for the mechanical keyboard is further pushed. But for traditional mechanical keyboard, the inside mechanical shaft mostly adopts the mode of sleeve, which is only suitable for the thicker desktop or externally-connected keyboard. To the thinner and thinner notebook computer keyboard, both the corner hand feeling and function are difficult to meet the user's demands.

SUMMARY

Invention object: the object of the invention is to provide a mechanical keyboard button structure, wherein the mechanical keyboard button structure supports stably and the corner has both better hand feeling and function.

Technical scheme: a mechanical keyboard button structure according to the invention includes a base plate, a circuit board, a mechanical switch and a keycap, wherein the base plate, the circuit board, the mechanical switch and the keycap are connected in order from bottom to top; the mechanism switch is used for guiding the keycap to move up and down and converting a pressure of the keycap into a switch signal to be transmitted to the circuit board to communicate a circuit; the mechanical switch includes a supporting plate and a switch spindle arranged on the supporting plate and further includes a pair of scissors, the upper portion of the pair of scissors is fixed with the bottom surface of the keycap, while the lower portion is fixed with the supporting plate, and the switch spindle passes through the pair of scissors and supports against the bottom surface of the keycap.

Wherein, the surface of the supporting plate is provided with a connecting portion, the switch spindle is sheathed on the outer wall of the connecting portion and can move up and down along the outer wall, an elastic mechanism is arranged between the switch spindle and the connecting portion; the connecting portion is internally provided with a first spring piece and a second spring piece for achieving the switch function, the switch spindle moves downward to trigger the first spring piece, so that the first spring piece and the second spring piece contact with each other and communicate the circuit to generate a switch signal.

Preferably, the supporting plate is formed by a base plate, and the surface of the base plate extends outward to form the connecting portion.

Preferably, the outer wall of the upper end of the connecting portion is provided with an upper flange extending outward, the inner wall of the lower end of the switch spindle is provided with a lower flange extending inward, the upper flange is mutually matched with the lower flange to limit the up-and-down motion stroke; the elastic mechanism is a spring mounted between the connecting portion and the switch spindle, wherein the switch spindle moves upward under the action of the resilience force of the spring until the switch spindle stops moving when the lower flange of the switch spindle is buckled with the upper flange of the connecting portion.

Further, the bottom surface of the switch spindle is provided with a guide rod axle, the guide rod axle is sheathed with a sliding block sliding up and down, and the sliding block can move up and down along the switch spindle and trigger the first spring piece.

Preferably, the pair of scissors comprises a pair of scissor pins, and the scissor pin is opened with a central axle hole that is convenient for the switch spindle to pass through.

Further, the bottom of the keycap is provided with an upper snap, the supporting plate is provided with a lower snap, and the scissor pins are coupled with the upper snap and the lower snap respectively.

Wherein, the circuit board is opened with a plurality of positioning holes, and the mechanical switch is fixed on the base plate.

Working principle: when the mechanical keyboard button structure according to the invention is working, the user presses the keycap with an acting force on the switch spindle, the switch spindle moves downward at a section of distance to touch the sliding block and drives the sliding block to move downward together, the sliding block triggers the first spring piece, the elastic force of the first spring piece gradually increases and then gradually reduces after achieving the peak point, at this time, the first spring piece and the second spring piece contact and communicate the circuit to generate a switch signal; and the sliding block makes a knocking noise when falling down, so it has stronger section feeling. When the user looses, the switch spindle is sprung up due to the resilience force and drives the sliding block to move upward together, but the sliding block is blocked fixedly when moving to a certain position, the switch spindle continues to spring up until the switch spindle stops moving to return to the initial position when the lower flange of the switch spindle is buckled with the upper flange of the connecting portion.

Beneficial effect: compared to the prior art, the invention has the remarkable advantages as follows: first, the mechanical axle structure is combined with the scissor structure via the mechanical keyboard button structure according to the invention, so that the button is supported more stably, the service life is long, and the corner has both better hand feeling and function; second, the mechanical keyboard button structure can be used for the keyboard with a shorter stroke, so that the keyboard is thinner and lighter and is more widely applied in the market; at last the whole circuit does not need to be replaced when a trigger circuit below the single key is damaged, and the single button can be repaired and replaced.

DETAILED DESCRIPTION OF THE PREFERRED EMBODIMENTS

The technical scheme of the invention will be further described hereinafter with reference to the drawings.

At present, a traditional mechanical keyboard is generally composed of a base plate 1, a circuit board 2, a mechanical switch 3 and a keycap 4, which are arranged from bottom to top. The keycap 4 is sheathed above the mechanical switch 3, the structure of the mechanical switch 3 is more tedious; moreover, the structure of the mechanical switch 3 is only suitable for thicker desktop or externally connected keyboard, the application scope is small, and the supporting performance is pool, so it fails to adapt to the keyboard with a shorter stroke.

Figure 1:
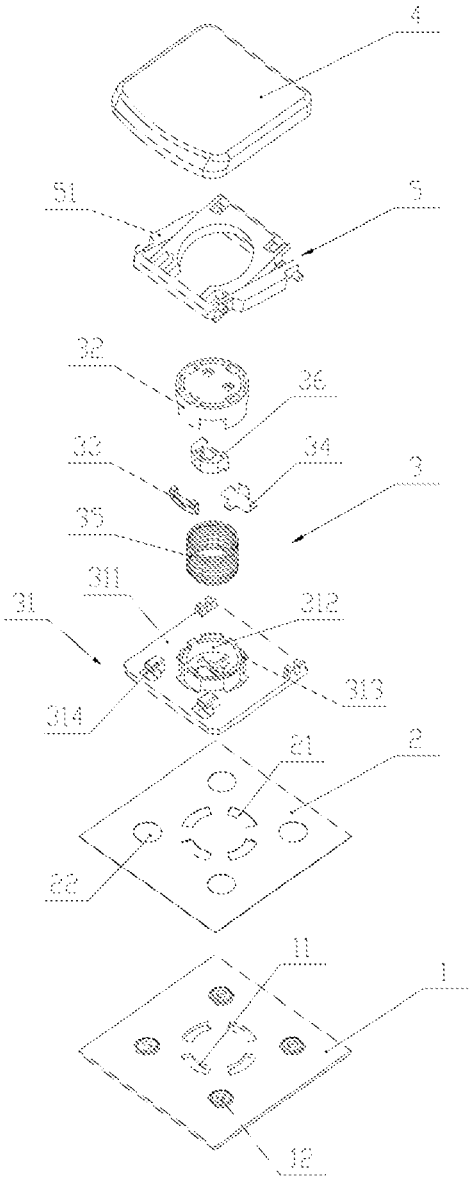
FIG. 1 is an assembling diagram of the invention.
Figure 4:
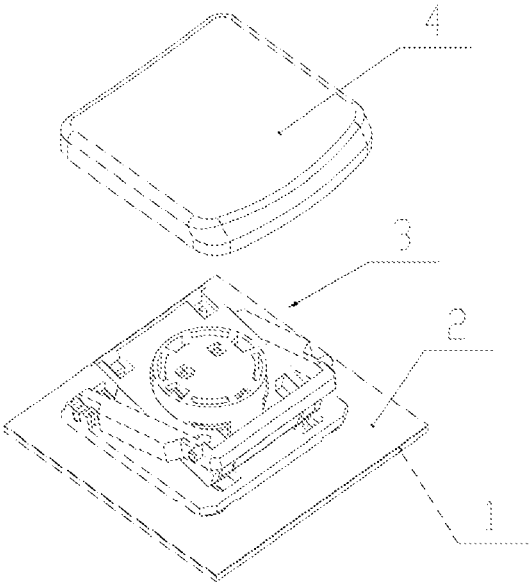
FIG. 4 is a schematic structural diagram of a keycap of the invention while mounting.

As show in FIG. 1 and FIG. 4, the invention discloses a mechanical keyboard button structure, including a base plate 1, a circuit board 2, a mechanical switch 3 and a keycap 4, wherein the base plate 1, the circuit board 2, the mechanical switch 3 and the keycap 4 are connected in order from top to bottom; the mechanism switch 3 is used for guiding the keycap 4 to move up and down and converting a pressure of the keycap 4 into a switch signal to be transmitted to the circuit board 2 to communicate a circuit; the mechanical switch 3 includes a supporting plate 31 and a switch spindle 32 arranged on the supporting plate 31 and further includes a pair of scissors 5, the upper portion of the pair of scissors 5 is fixed with the bottom surface of the keycap 4, while the lower portion is fixed with the supporting plate 31, and the switch spindle 32 passes through the pair of scissors 5 and supports against the bottom surface of the keycap 4.

Figure 5:
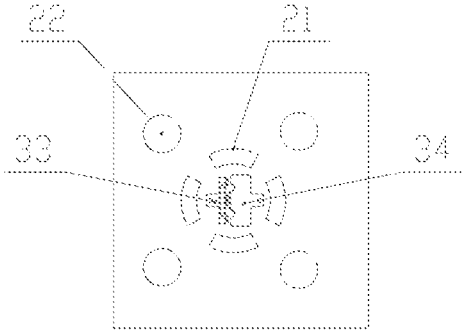
FIG. 5 is a schematic structural diagram of mounting a first spring piece and a second spring piece in the invention.
Figure 6:
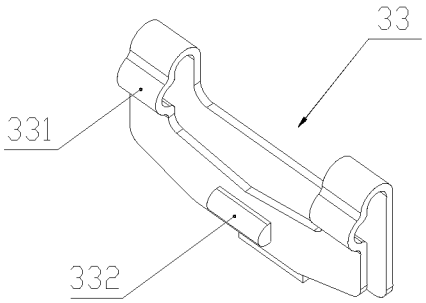
FIG. 6 is a schematic structural diagram of a first spring piece in the invention.
Figure 7:
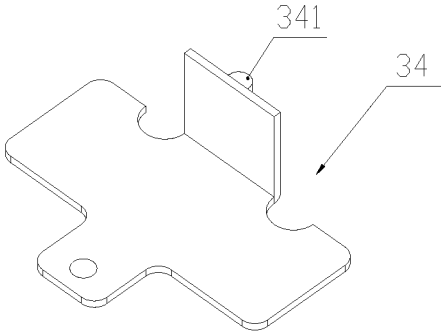
FIG. 7 is a schematic structural diagram of a second spring piece in the invention.

As shown in FIG. 1 and FIG. 5, the circuit board 2 is provided with a current circuit for conducting a mechanical switch signal or command, and the circuit board 2 is opened with a plurality of positioning holes 21 and mounting holes 22 for arranging the mechanical switch 3.

As shown in FIG. 1, the base plate 1 is a flat-shaped structure consisting with the shape and the size of the circuit board 2, and the base plate 1 is arranged below the circuit board 2 and is opened with a base plate positioning hole 11 and a base plate mounting hole 12 for mounting a mechanical switch 3.

Figure 3:
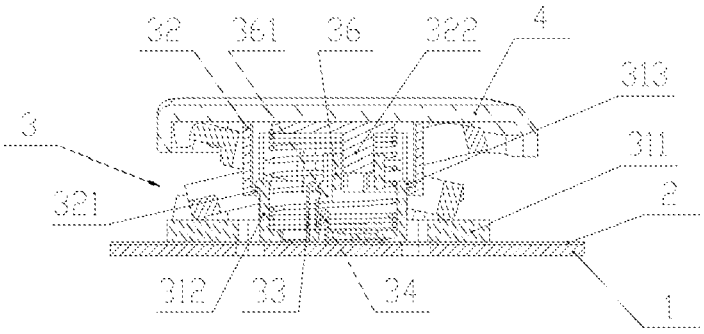
FIG. 3 is a sectional view of the invention.

As shown in FIG. 1 and FIG. 3, the supporting plate 31 is provided with a connecting portion 312, wherein the supporting plate 31 is formed by a base plate 311, the connecting portion 312 can be used as an independent part to be arranged on the base plate 311 and also can be integrally formed with the base plate 311, and the surface of the base plate 311 extends outward to form the connecting portion 312. The outer wall of the connecting portion 312 is sheathed with the switch spindle 32, and the switch spindle 32 can move along the outer wall of the connecting portion 312 up and down. The outer wall of the upper end of the connecting portion 312 is provided with an upper flange 313 extending outward, the inner wall of the lower end of the switch spindle 32 is provided with a lower flange 321 extending inward, the upper flange 313 is mutually matched with the lower flange 321 to limit the up-and-down motion stroke; the elastic mechanism 35 is a spring mounted between the connecting portion and the switch spindle, wherein the switch spindle 32 moves upward under the action of the resilience force of the spring until the switch spindle 32 stops moving when the lower flange 321 of the switch spindle is buckled with the upper flange 313 of the connecting portion. Wherein the bottom surface of the switch spindle 32 is provided with a guide rod axle 322, the guide rod axle 322 is sheathed with a sliding block 36 capable of sliding along the guide rod axle 322, the sliding block 36 is provided with a groove 361, and the sliding block 36 can move up and down along with the switch spindle 32.

As shown in FIG. 1, FIG. 5, FIG. 6 and FIG. 7, according to the invention, the connecting portion 312 is internally provided with a first spring sheet 33 and a second spring sheet 34, the upper end of the first spring sheet 33 is provided with a camber 331 that is bent and formed by itself, the lower end of the first spring sheet 33 is provided with a left contact portion 332, the second spring sheet 34 is provided with a right contact portion 341, and the arc 331 is matched with the groove 361 on the sliding block 36 when the key is not pressed, at this time, the left contact portion 332 does not contact with the right contact portion 341, and the circuit is disconnected. When the key is applied with force by the user, the switch spindle 32 moves downward at a section of distance to touch the sliding block 36 and drives the sliding block 36 to move downward together, the sliding block 36 triggers the first spring piece 33, the elastic force of the first spring piece 33 gradually increases and then gradually reduces after achieving the peak point, at this time, the left contact portion 332 on the first spring piece 33 and the right contact portion 341 on the second spring piece 34 contact and communicate the circuit to generate a switch signal; and the sliding block 36 makes a knocking noise when falling down, so it has stronger section feeling. When the user removes the pressure applied on the keycap 4, the switch spindle 32 is sprung up due to the resilience force and drives the sliding block 36 to move upward together, but the groove 361 of the sliding block 36 is matched with the camber 331 on the first spring piece 33, the sliding block 36 is blocked by the first spring piece 33 when moving to a certain position, the switch spindle 32 continues to spring up until the switch spindle 32 stops moving to return to the initial position when the lower flange 321 of the switch spindle 32 is buckled with the upper flange 313 of the connecting portion.

Figure 2:
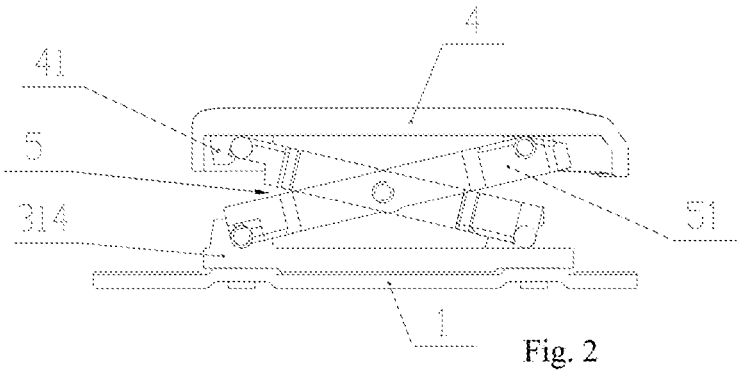
FIG. 2 is a schematic structural diagram of the invention.

As shown in FIG. 1 and FIG. 2, in order to increase the stability of the keycap 4 when being pressed, the mechanical keyboard button structure discloses a pair of scissors 5, the pair of scissors 5 includes a pair of scissor pins 51, and the scissor pin 51 is opened with a central axle hole convenient for the switch spindle 32 to pass through. Wherein the bottom of the keycap 4 is provided with an upper snap 41, the scissor pin 51 is coupled with the upper snap 41 of the keycap to assist the keycap 4 in smoothly dropping when being pressed. The supporting plate 31 is provided with a lower snap 314, the scissor pin 51 is coupled with the lower snap 314 to fix the supporting plate 31 and the scissor pin 51.

The pair of scissors 5 cannot only be connected with the keycap 4 and the supporting plate 31, but also can drive the keycap 4 to move up and down; moreover, the pair of scissors 5 can also uniformly disperse the pressure when the keycap 4 is pressed to improve the trigger sensitivity of the mechanical switch and the stability of the key.

The invention claimed is:

1. A mechanical keyboard button structure, comprising a base plate, a circuit board, a mechanical switch and a keycap, wherein the base plate, the circuit board, the mechanical switch and the keycap are connected in order from bottom to top; the mechanism switch is used for guiding the keycap to move up and down and converting a pressure of the keycap into a switch signal to transmit to the circuit board to communicate a circuit; the mechanical switch comprises a supporting plate and a switch spindle arranged on the supporting plate and further comprises a pair of scissors, the upper portion of the pair of scissors is fixed with the bottom surface of the keycap, while the lower portion is fixed with the supporting plate, and the switch spindle passes through the bottom surface of the pair of scissors supporting against the keycap, wherein the surface of the supporting plate is provided with a connecting portion, the switch spindle is sheathed on the outer wall of the connecting portion and can move up and down along the outer wall, an elastic mechanism is arranged between the switch spindle and the connecting portion; the connecting portion is internally provided with a first spring piece and a second spring piece for achieving the switch function, the switch spindle moves downward to trigger the first spring piece, so that the first spring piece and the second spring piece contact with each other and communicate the circuit to generate a switch signal, and wherein the outer wall of the upper end of the connecting portion is provided with an upper flange extending outward, the inner wall of the lower end of the switch spindle is provided with a lower flange extending inward, the upper flange and the lower flange are mutually matched with each other to limit the up-and-down motion stroke; the elastic mechanism is a spring mounted between the connecting portion and the switch spindle, wherein the switch spindle moves upward under the action of the resilience force of the spring until the switch spindle stops moving when the lower flange of the switch spindle is buckled with the upper flange of the connecting portion.

2. A mechanical keyboard button structure, comprising a base plate, a circuit board, a mechanical switch and a keycap, wherein the base plate, the circuit board, the mechanical switch and the keycap are connected in order from bottom to top; the mechanism switch is used for guiding the keycap to move up and down and converting a pressure of the keycap into a switch signal to transmit to the circuit board to communicate a circuit; the mechanical switch comprises a supporting plate and a switch spindle arranged on the supporting plate and further comprises a pair of scissors, the upper portion of the pair of scissors is fixed with the bottom surface of the keycap, while the lower portion is fixed with the supporting plate, and the switch spindle passes through the bottom surface of the pair of scissors supporting against the keycap, wherein the surface of the supporting plate is provided with a connecting portion, the switch spindle is sheathed on the outer wall of the connecting portion and can move up and down along the outer wall, an elastic mechanism is arranged between the switch spindle and the connecting portion; the connecting portion is internally provided with a first spring piece and a second spring piece for achieving the switch function, the switch spindle moves downward to trigger the first spring piece, so that the first spring piece and the second spring piece contact with each other and communicate the circuit to generate a switch signal, and wherein the bottom surface of the switch spindle is provided with a guide rod axle, the guide rod axle is sheathed with a sliding block sliding up and down, and the sliding block can move up and down along the switch spindle and trigger the first spring piece.

* * * * *